US005397227A

United States Patent [19]

Hodan et al.

[11] Patent Number: 5,397,227

[45] Date of Patent: * Mar. 14, 1995

[54] APPARATUS FOR CHANGING BOTH NUMBER AND SIZE OF FILAMENTS

[75] Inventors: John A. Hodan, Arden; Robert N. Armstrong, Asheville; Wei Li, Arden, all of N.C.

[73] Assignee: BASF Corporation, Parsippany, N.J.

[ * ] Notice: The portion of the term of this patent subsequent to Sep. 15, 2009 has been disclaimed.

[21] Appl. No.: 181,369

[22] Filed: Jan. 13, 1994

Related U.S. Application Data

[63] Continuation of Ser. No. 892,076, Jun. 2, 1992, abandoned, which is a continuation-in-part of Ser. No. 633,810, Dec. 26, 1990, Pat. No. 5,147,197.

[51] Int. Cl.[6] ..... B29C 47/12

[52] U.S. Cl. ..... 425/192 S; 264/39; 264/169; 425/382.4; 425/464

[58] Field of Search ..... 425/72.2, 131.5, 185, 425/192 S, 382.2, 198, 382.4, 464, 466; 264/39, 40.1, 103, 171, 176.1, 169

[56] References Cited

U.S. PATENT DOCUMENTS

| | | | |
|---|---|---|---|
| 1,983,330 | 12/1934 | Welch | 425/464 |
| 2,517,711 | 8/1950 | Pool et al. | 425/464 |
| 2,883,261 | 4/1959 | McGeorge, Jr. | 425/464 |
| 2,980,492 | 4/1961 | Jamieson et al. | 264/210.8 |
| 3,028,627 | 4/1962 | McCormick | 425/198 |
| 3,095,607 | 7/1963 | Cobb, Jr. | 425/463 |
| 3,225,383 | 12/1965 | Cobb, Jr. | 425/198 |
| 3,259,938 | 7/1966 | Martin | 425/464 |
| 3,289,249 | 12/1966 | Nakayama et al. | 425/131.5 |
| 3,336,633 | 8/1967 | Curran, Jr. | 425/464 |
| 3,466,703 | 9/1969 | Heckrotte | 425/198 |
| 3,585,685 | 6/1971 | McDermott | 425/192 S |
| 3,601,846 | 8/1971 | Hudnall | 425/131.5 |
| 3,659,988 | 5/1972 | Walczak | 425/198 |
| 3,938,925 | 2/1976 | Lees | 425/464 |
| 4,738,607 | 4/1988 | Nakajima et al. | 425/192 S |
| 5,147,197 | 9/1992 | Hodan et al. | 425/192 S |
| 5,169,584 | 12/1992 | Ross et al. | 425/464 |

FOREIGN PATENT DOCUMENTS

| | | | |
|---|---|---|---|
| 0492077 | 7/1992 | European Pat. Off. . | |
| 48-0564 | 1/1973 | Japan . | |
| 3-113010 | 5/1991 | Japan | 425/464 |
| 120285 | 11/1959 | U.S.S.R. | 425/198 |
| 1482806 | 5/1989 | U.S.S.R. | 425/464 |
| 1490169 | 6/1989 | U.S.S.R. | 425/464 |

OTHER PUBLICATIONS

Research Disclosure, No. 331, Nov. 1991, Emsworth, GB Anonymous "Spinning Pack Modification".

*Primary Examiner*—Jay H. Woo
*Assistant Examiner*—Robert B. Davis
*Attorney, Agent, or Firm*—Karen M. Dellerman

[57] ABSTRACT

A sealing plate upstream of a spinneret has cylindrical flow channels, at least some of which have a first diameter. Each of the flow channels corresponds in position to a bore in the spinneret plate. The number and denier of extruded filaments can be altered by simply changing the plate. The plate provides a seal by deflecting under the extrusion pressure.

10 Claims, 4 Drawing Sheets

APPARATUS FOR CHANGING BOTH NUMBER AND SIZE OF FILAMENTS

CROSS-REFERENCE TO RELATED APPLICATIONS

This application is a continuation of U.S. patent application Ser. No. 07/892,076, filed Jun. 2, 1992, now abandoned, which in turn is a continuation-in-part of U.S. patent application Ser. No. 07/633,810, filed on Dec. 26, 1990, and issuing as U.S. Pat. No. 5,147,197, on Sep. 15, 1992.

FIELD OF THE INVENTION

This invention relates generally to melt spinning filaments or fibers using a spinneret. More particularly, this invention relates to an apparatus for changing the number and size of filaments being spun from a single spinneret.

BACKGROUND OF THE INVENTION

Spinneret assemblies for spinning synthetic filaments or fibers typically include an inlet block having an inlet port through which the material to be spun is introduced into the spinneret assembly and a chamber containing filtering material, a distribution plate, a distribution cavity, a metering plate and a spinneret plate. The metering plate includes a number of apertures having a compound shape, consisting of a capillary and a counterbore. The spinneret plate normally includes a corresponding number of bores having a compound shape consisting of a counterbore and a capillary or spinning orifice.

U.S. Pat. No. 3,095,607 to Cobb describes a typical spinneret assembly. Other spinneret assemblies are described in U.S. Pat. No. 3,028,627 to McCormick; U.S. Pat. No. 2,883,261 to McGeorge; U.S. Pat. No. 3,225,383 to Cobb; U.S. Pat. No. 3,289,249 to Nakayama et al.; U.S. Pat. No. 3,601,846 to Hudnall; U.S. Pat. No. 3,659,988 to Walczak; and U.S. Pat. No. 4,738,607 to Nakajima et al.

It is sometimes desirable to change the number of filaments or deniers of the filaments being spun from a single spinneret. Reasons for altering the filament count may include product variations, keeping the total tow denier constant while changing the individual filament denier, changing quenching characteristics and maintaining spinning speed at higher denier per filament where extruder capacity is limited. Also, mixed denier filaments produce unique product characteristics.

The traditional method for changing filament count is to individually plug spinneret capillaries using a soft metal bar of approximately the same diameter as the counterbore. This method is time consuming, risks damage to the spinneret, and does not insure a leak-free seal.

The traditional method of generating mixed deniers is to make expensive, precision metering plates for each mixture.

Another known method for spinning a number of different filament counts from a single spinneret plate is described in U.S. Pat. No. 3,336,633 to Curran. Curran employs metering plates having a number of apertures lower than the number of orifices in the spinneret plate. Since the compound shape of the apertures in the metering plate are normally precision drilled to provide a desired pressure drop, the metering plates are relatively expensive to produce and maintaining a stockpile of metering plates to provide a variety of fiber counts may be cost-prohibitive.

U.S. Pat. No. 2,980,492 to Jamieson et al. describes an apparatus for making mixed denier filaments. The apparatus requires two separate cavities within a single spin pack. Each cavity corresponds to its own portion of the spin pack. This complicated arrangement allows polymer to be fed at two different feed rates, thereby making different denier filaments.

SUMMARY OF THE INVENTION

It is an object of the invention to provide a simple and inexpensive apparatus for changing the filament count and denier mixture from a spinneret plate.

It is also an object of the invention to provide an apparatus which provides a good seal of one or more capillaries of a spinneret plate without endangering the very expensive spinneret capillaries.

It is a further object of this invention to economically change the deniers of individual filaments in a single yarn spun from the spinneret while avoiding the high cost and expense of purchasing new precision metering plates.

These objectives and other advantages are achieved by providing a sealing plate upstream of the spinneret.

One aspect of the present invention involves a spinneret assembly including a spinneret plate with an upstream side and having a number of bores, each bore with one or more tapered sections; and a sealing plate adjacent to the upstream side of the spinneret plate and forming an interface therewith. The sealing plate has cylindrical flow channels formed therein. At least some of said flow channels have a first diameter and at least some of said flow channels have a second diameter which is smaller than the first diameter. Each of said flow channels corresponds in position to a bore in the spinneret plate.

In another aspect of the invention, a spinneret assembly includes a spinneret plate with an upstream side having a number of bores, each bore with one or more tapered sections; and a sealing plate positioned upstream from the spinneret plate. The sealing plate has cylindrical flow channels which are fewer in number than the bores. Each of the flow channels corresponds in position to a bore in the spinneret plate.

Yet another aspect of the present invention involves a spinneret assembly for extruding polymeric material under pressure, including a spinneret plate having a number of bores and an upstream side; and upstream thereof, and next adjacent thereto, a sealing plate made of a material and having flow channels therein and which sealingly deflects under spinning pressure. The deflection does not exceed the ultimate plastic limit of the sealing plate material. Each of the flow channels corresponds in position to a bore in said spinneret plate.

The present invention will now be described more fully with reference to the accompanying drawings, in which illustrative embodiments of the invention are shown. This invention can, however, be embodied in many different forms and the invention should not be construed as being limited to the specific embodiments set forth herein. Rather, Applicants provide these embodiments so that this disclosure will be thorough and complete and will fully convey the intent of the invention to those skilled in the art.

DETAILED DESCRIPTION OF THE PREFERRED EMBODIMENTS

Figure 1:
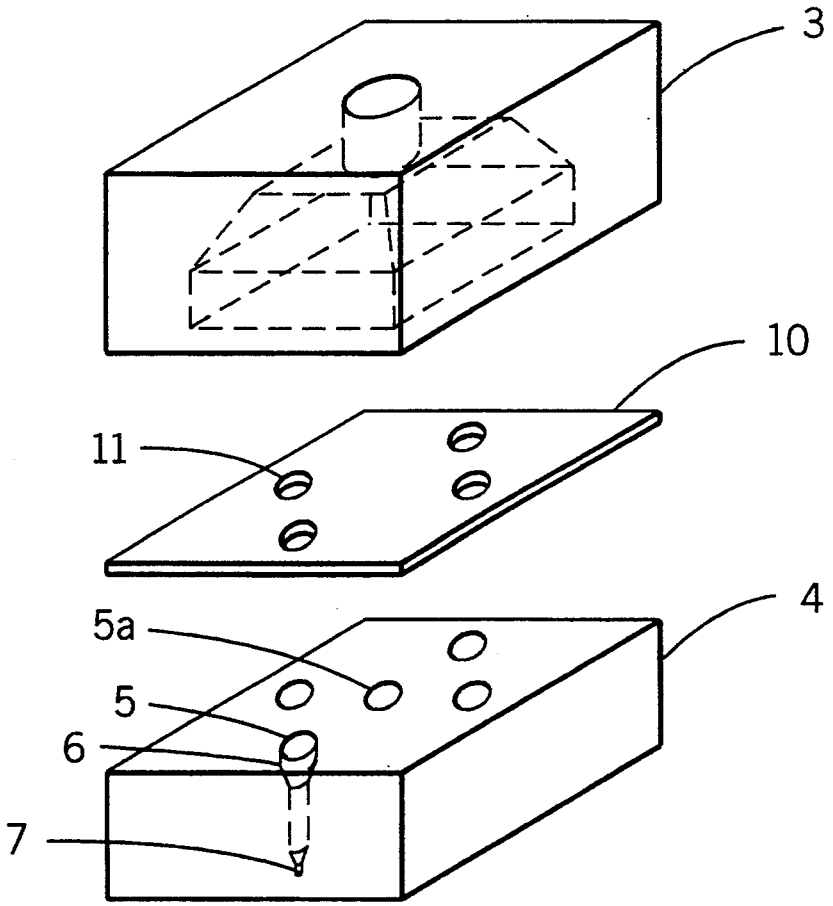
FIG. 1 is an exploded perspective view of the spinneret assembly in accordance with the invention.

Referring now to FIG. 1, a spinneret assembly includes an inlet block 3 and a spinneret plate 4. The spinneret plate 4 includes a number of bores 5. The bores 5 may be of compound shape, having a relatively large counterbore 6 at the upstream side and a relatively small spinning orifice 7 through which the material being spun exits the spinneret plate 4.

Between the inlet block 3 and the spinneret plate 4 is sealing plate 10. Sealing plate 10 includes one or more flow channels 11, each of which is positioned to correspond with one of the bores 5 in the spinneret plate 4. The sealing plate 10 contains at least one less flow channel 11 than the number of bores 5 in the spinneret plate 4. Thus, the sealing plate 10, will block at least one bore 5 of the spinneret plate 4, preventing the passage of the material being spun, thereby changing the filament count from the spinneret. As seen in FIG. 1, there is no flow channel corresponding to bore 5*a* in spinneret plate 4, thereby changing the filament count from 5 to 4 from the illustrated spinneret. Surprisingly, as illustrated in the Examples below, the denier and number of filaments may be adjusted with the present invention.

Sealing plate 10 can be manufactured from any suitable material, such as, for example, mild steel, stainless steel, brass or aluminum. However, the material characteristics will dictate the appropriate thickness of the sealing plate. The thickness of the sealing plate must be such that the plate deflects to form a seal around the edge of the counterbore of the spinneret capillary. However, the sealing plate must not be so thin that the pressure above the seal generates a force great enough to exceed the ultimate plastic limit of the material in the shearing zone generated at the edge of the counterbore. This could result in bursting of the sealing plate and loss of the seal. In the case where the sealing plate is also used to adjust the diameter of the filaments, the thickness and properties of the sealing plate must be further limited to prevent failure at the sealing plate aperture (metering hole) due to generation and propagation of a crack. This can be further reduced by the method of aperture manufacture. For example, cleanly drilled, punched, etched or machined round holes are less likely to initiate cracks than non-round or jagged holes.

Sealing plate 10 and flow channels can be formed by any suitable manufacturing technique such as, for example, die cutting, drilling, punching, stamping, etching, machining, or molding. Any suitable means may be employed to align the various components of the spinneret assembly in precise register with each other and to maintain the assembled spinneret assembly in a tight fitting relationship. For example, apertures (not shown) may be formed in each component which, in the assembled spinneret assembly, provide thruways accommodating terminally threaded aligning bolts or rods (not shown) which receive locking nuts (not shown).

The overall dimensions of the spinneret plate 4 and the sealing plate 10 may vary considerably. In general, the spinneret plate and the sealing plate will have the same or substantially the same planar dimensions. While in some instances spinneret plates may be as large as a few feet in length, typically, the planar dimensions range from about 1.0 to about 12 inches in length and about 1.0 to about 8.0 inches in width. The thickness of the spinneret and sealing plate may be the same or different. Preferably, however, the sealing plate 10 will be substantially thinner than the spinneret plate 4. Typically, the thickness of spinneret plate 4 is between about 0.25 and about 1.5 inches, while the thickness of sealing plate 10 is preferably between about 0.003 and about 0.1 inches.

The location or pattern of the bores 5 in spinneret plate 4 and the corresponding flow channels 11 in sealing plate 10 may also vary considerably. Additionally, the diameter of the bores 5 and the flow channels may vary, ranging, for example, between about 0.1 to about 0.3 inches in diameter. Preferably, the diameter of the flow channel 11 corresponds to the diameter of the counterbore 6 at the upstream side of spinneret plate 4.

Figure 2:
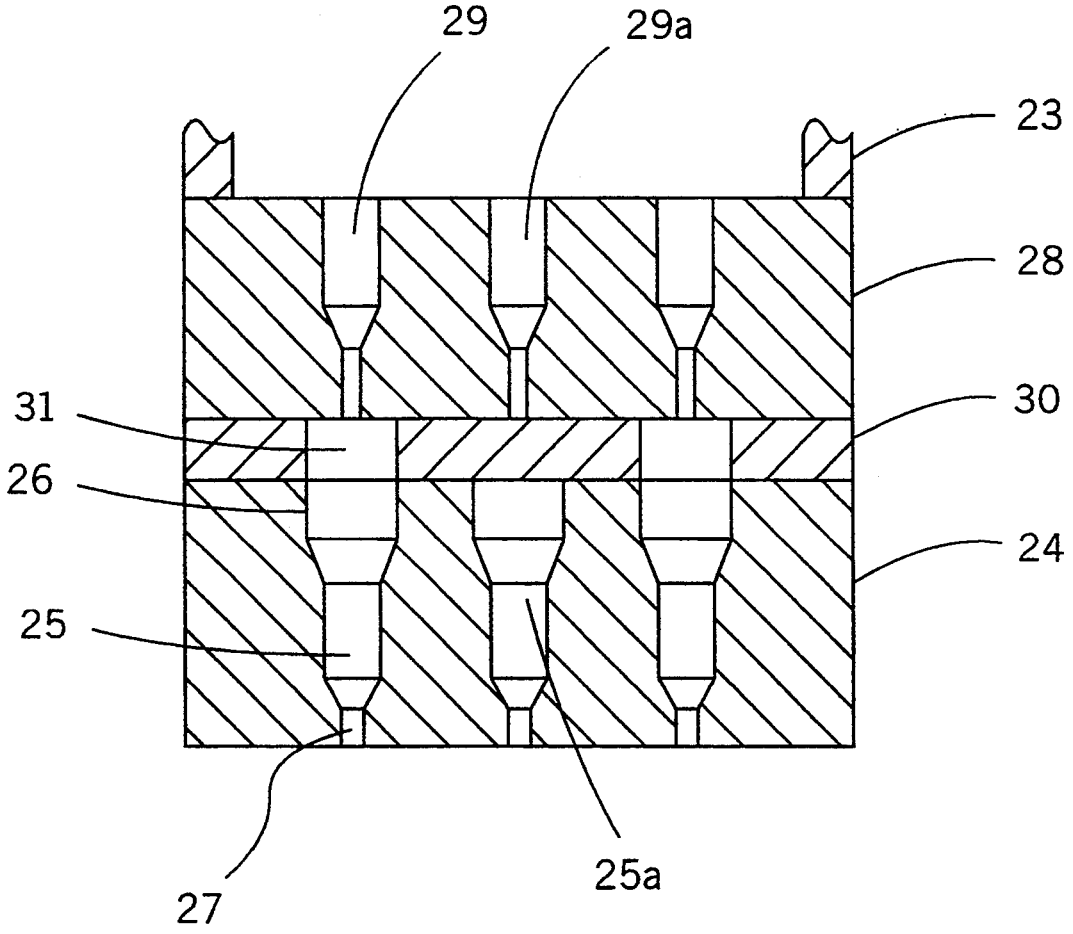
FIG. 2 is a partial axial longitudinal section of an alternative embodiment of a spinneret assembly in accordance with the invention.

Referring now to FIG. 2, in another embodiment of the invention, the spinneret assembly includes an inlet block 23, a metering plate 28, and a spinneret plate 24. Sealing plate 30 is located between the metering plate 28 and the spinneret plate 24.

The metering plate 28 has a number of apertures 29 bored therein. The number and location of the apertures 29 in the metering plate 28 correspond to the number and location of bores 25 in the spinneret plate 24. The sealing plate 30 includes a number of flow channels 31 formed therein.

The flow channels 31 are positioned to correspond with the apertures 29 in the metering plate 28 and the bores 25 in the spinneret plate 24. The sealing plate 30 contains at least one less flow channel 31 than the number of apertures 29 and bores 26. Thus, the sealing plate 30 will prevent the passage of the material being spun from aperture 29*a* to bore 25*a*, thereby reducing the filament count from the spinneret.

Figure 3:
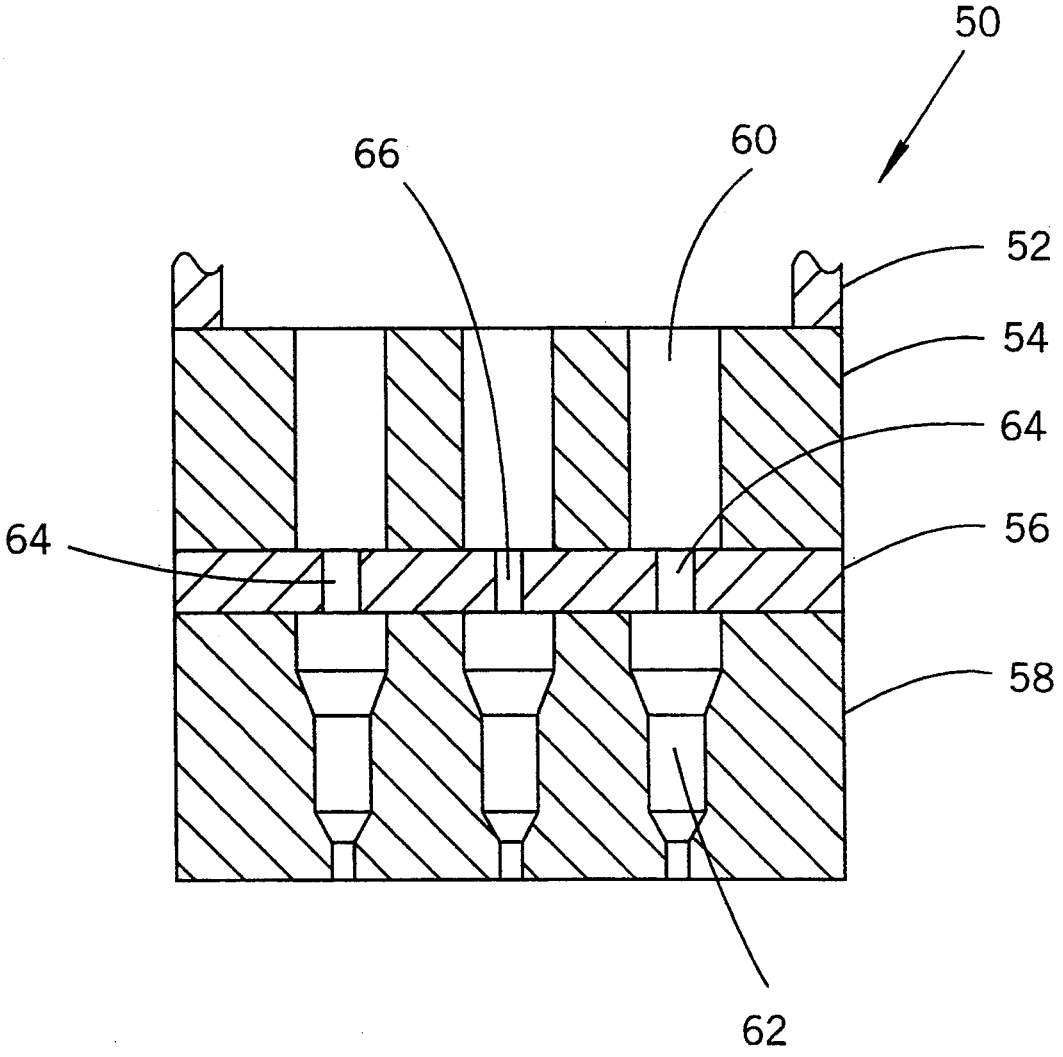
FIG. 3 is a partial axial longitudinal section of another alternative embodiment of the present invention.

The sealing plate may also contain apertures of different sizes as shown in FIG. 3. FIG. 3 shows in cross-sectional elevation another embodiment of the spin pack of the present invention. As shown, spinneret assembly 50 includes inlet block 52, plate 54, sealing plate 56 and spinneret plate 58.

Plate 54 has a number of apertures 60 bored therein. The number and location of apertures 60 correspond to the number and location of bores 62 in spinneret plate 58.

Sealing plate 56 includes a number of flow channels therein. Two sizes of flow channels are shown. Larger channels 64 facilitate larger denier filaments when molten polymer passes therethrough to spinneret plate 58 and bores 62. Small channel 66 likewise facilitates small denier filaments. The larger channels may be as large as the opening diameter of the spinneret plate.

Figure 4:
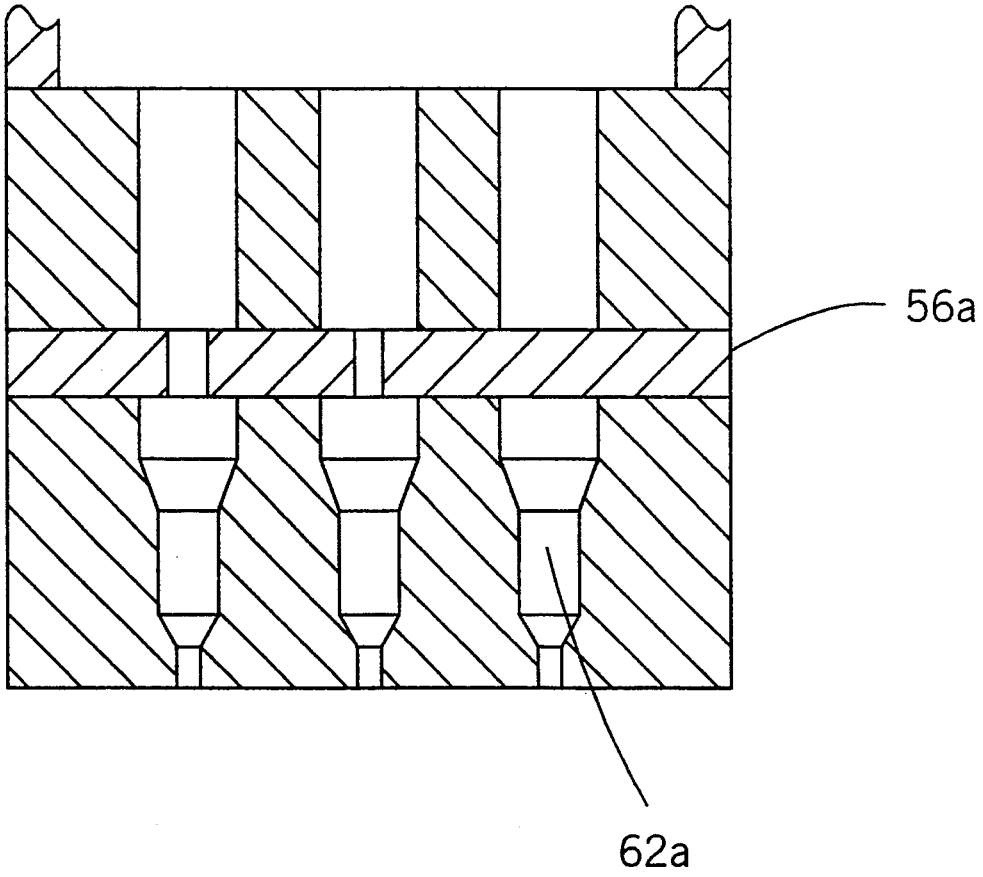
FIG. 4 is a partial cross-section of a modification of the embodiment of FIG. 3.

FIG. 4 is a partial cross-section of a modification of FIG. 3 wherein one spinneret bore 62*a* is sealed by sealing plate 56*a*.

As shown, when apertures are of different sizes, they may or may not be fewer in number than bores 62. This causes differing flows to proceed to the spinneret capillaries. The total flow through any component flow channel is determined by the total pressure drop. Orifices in a spinneret or a metering plate usually are identical so that uniform filament cross-section and denier per filament (DPF) can be achieved. With the sealing plate of the present invention having varying hole sizes in the plate, a unique yarn with different filament deniers and geometries can be made using the normal spinneret or spinneret-metering plate combination.

While not wishing to be bound by theory, the following may explain the operation of the present invention. At the top of the sealing plate (or metering plate if one is used), polymer pressure is generally equalized from channel to channel due to the rather free lateral flow of polymer. This results in approximately the same pressure drop for different polymer paths from the sealing plate (or metering plate) top to the spinneret bottom face as governed by the following equation:

$$\sum_k \Delta P_{ik} = \sum_k \Delta P_{jk} = \text{Constant} \tag{1}$$

where $\Delta P_i$ and $\Delta P_j$ denote polymer pressure drops for two arbitrary polymer paths, and the subscript k denotes the Kth segment in an individual polymer path. Polymer pressure drop of a segment can be obtained from:

$$\Delta P_{ik} = \left( \frac{2^{2-nk} L_k m_k \lambda_k^{nk}}{A_k^{nk} D_{hk}^{nk+1}} \right) Q_i^{nk} \tag{2}$$

where $L_k$, $A_k$, $D_{hk}$ are the segment length, area and hydraulic diameter respectively. $\lambda_k$ is the segment (orifice) shape factor. The polymer rheological parameters, $m_k$ and $n_k$, are based on the assumption that the polymer obeys the power law as defined by $\pi = m\gamma^n$, where $\pi$ is the shear stress and $\gamma$ is the average wall shear rate. $Q_i$ is the volumetric rate of polymer flow in that channel. Since a filament denier is proportional to the polymer flow rate of the channel it comes from, the denier ratio of two filaments is equal to the ratio of corresponding polymer flow rates. If the power law parameters of a polymer (m and n) are known, the denier ratio of any two filaments can be calculated according to Equations 1 and 2 by using actual dimensions of the orifices (holes).

If polymer shear rates in different channels and segments are within a power of ten, the DPF ratio ($R_{dpf}$) of an arbitrary filament to the smallest filament in the yarn can be estimated by the following simplified equation:

$$R_{dpf} = \frac{DPF_n}{DPF_o} = \sqrt[n]{\frac{1 + \sum_k \left(\frac{\lambda_k}{16}\right)^n \frac{L_{sk} S_{sk}^{n+1}}{A_{sk}^{2n+1}}}{\frac{1}{D_r^{3n+1}} + \sum_k \left(\frac{\lambda_k}{16}\right)^n \frac{L_{sk} S_{sk}^{n+1}}{A_{sk}^{2n+1}}}} \tag{3}$$

where $DPF_n$ and $DPF_o$ are the deniers of an arbitrary and the smallest filament in the yarn and $D_r$ is the diameter ratio of the arbitrary hole to the smallest hole. $L_{sk}$, $S_{sk}$ and $A_{sk}$ are the length ratio, perimeter ratio and area ratio of a segment to the smallest hole in the sealing plate. Dr is the sealing plate diameter ratio. An average value for n for the shear rate range should be determined.

It should be understood that the sealing plate may be positioned adjacent to the upstream face of the metering plate, or at any other position in the spinneret assembly provided that the sealing plate prevents the passage of the material to be spun into one or more particular spinneret bores, thereby changing the filament count.

EXAMPLE 1

A series of continuous filament yarns is made using nylon 6 polymer of 2.7 relative viscosity. The molten polymer is extruded through a spinneret with 102 trilobal-shaped orifices, each comprising three intersecting slots of 0.125 mm wide and 0.914 mm long. Main operating conditions are: polymer temperature 270° C., polymer throughput 246 g/min/spinneret, quench air flow rate 93.9 ft/min (28.6 m/min) and winding speed 650 m/min. Three spinneret packs are made using the configuration demonstrated in FIG. 2 with 75, 60 and 49 open channels, respectively, in the sealing plates. The sealing plates are 0.003" (0.076 mm) thick with 0.047" (1.19 mm) diameter holes. A control spin pack is also made using the same configuration but without a sealing plate. Although polymer throughput was the same, yarns produced by these four spin packs are different in number of filaments, DPF and modification ratio (MR) as listed in TABLE 1.

TABLE 1

| | Control | Sample Identification | | |
|---|---|---|---|---|
| | A | B | C | D |
| Yarn denier | 3685 | 3647 | 3656 | 3654 |
| Number of filaments | 102 | 75 | 60 | 49 |
| Denier per filament | 36.1 | 48.6 | 60.9 | 74.6 |
| Modification ratio | 2.64 | 2.80 | 3.20 | 2.92 |

EXAMPLE 2

A series of continuous filament yarns is made using nylon 6 polymer of 2.7 relative viscosity. The molten polymer is extruded through a spinneret with 68 trilobal-shaped orifices which are identical to the orifices described in EXAMPLE 1. Main operating conditions are: polymer temperature 270° C., polymer throughput 177 g/min/spinneret and winding speed 600 m/min. Three spinneret packs are made using the configuration demonstrated in FIG. 2 with 58, 52 and 46 open channels in the sealing plates. The sealing plates are 0.003" (0.076 mm) thick with 0.047" (1.19 mm) diameter holes. Another spin pack is also made using the same configuration but having 85 orifices in the spinneret and without a sealing plate. Quenching air flow rate was adjusted for each spin pack to get the same 3.0 modification ratio for all four yarns. Yarns produced by these four spin packs differ in number of filaments and DPF as listed in TABLE 2.

TABLE 2

| | Control | | | |
|---|---|---|---|---|
| | E | F | G | H |
| Yarn denier | 1108 | 1133 | 1111 | 1119 |
| Number of filaments | 85 | 58 | 52 | 46 |
| Denier per filament | 13.0 | 19.5 | 21.4 | 24.3 |

EXAMPLE 3

A continuous filament yarn is made using nylon 6 polymer of 2.7 relative viscosity. The molten polymer is extruded through a spinneret with 102 trilobal-shaped orifices which are identical to the orifices described in EXAMPLE 1. The spinneret pack is made using the configuration demonstrated in FIG. 3. The sealing plate is 0.400 mm thick. Holes in the sealing plate are in two different sizes as shown in FIG. 3 and with diameters of 3.175 mm and 0.350 mm respectively. Main operating conditions are: polymer temperature 270° C., polymer throughput 287 g/min/spinneret, quench air flow rate 97.5 ft/min (29.7 m/min) and winding speed 630 m/min. The whole yarn is 4154 denier. The resultant filament DPFs and MRs are listed in TABLE 3.

TABLE 3

| Filament Size | No. of Holes or Filaments | Hole Diameter (mm) | DPF | MR |
|---|---|---|---|---|
| Large | 17 | 3.175 | 100.2 | 3.01 |
| Small | 85 | 0.350 | 28.8 | 2.64 |

EXAMPLE 4

Two continuous filament yarns are made using nylon 6 polymer of 2.7 relative viscosity. The molten polymer is extruded through a spinneret with 68 trilobal-shaped orifices which are identical to the orifices described in EXAMPLE 1. Two spinneret packs are made using the configuration demonstrated in FIG. 3. The sealing plates are 0.015" (0.381 mm) thick. Holes in each sealing plate are in two different sizes. Main operating conditions are: polymer temperature 270° C., polymer throughput 177 g/min/spinneret, quench air flow rate 93.9 ft/min (28.6 m/min) and winding speed 600 m/min. Each yarn produced contains filaments with two different sizes. The hole sizes and filament properties are listed in TABLE 4.

TABLE 4

| Sample No. | Filament Size | No. of Holes or Filaments | Hole Diameter (mm) | DPF | MR |
|---|---|---|---|---|---|
| Il | Large | 14 | 1.588 | 53.8 | 3.37 |
| Is | Small | 54 | 0.794 | 37.9 | 3.27 |
| Jl | Large | 14 | 3.175 | 57.4 | 3.27 |
| Js | Small | 54 | 0.794 | 36.9 | 3.09 |

EXAMPLE 5

A series of continuous filament yams is made using nylon 6 polymer of 2.7 relative viscosity. The molten polymer is extruded through a spinneret with 68 trilobal-shaped orifices which are identical to the orifices described in EXAMPLE 1. Three spinneret packs are made using the configuration demonstrated in FIG. 3. The sealing plates are 0.020" (0.508 mm) thick. Holes in each sealing plate are in two different sizes. Main operating conditions are polymer temperature 270° C., polymer throughput 177 g/min/spinneret, quench air flow rate 93.9 ft/min (28.6 m/min) and winding speed 600 m/min. Each yarn produced contains filaments with two different sizes. The hole sizes and filament properties are listed in TABLE 5.

TABLE 5

| Sample No. | Filament Size | No. of Holes or Filaments | Hole Diameter (mm) | DPF | MR |
|---|---|---|---|---|---|
| Kl | Large | 24 | 1.588 | 50.1 | 3.09 |

TABLE 5-continued

| Sample No. | Filament Size | No. of Holes or Filaments | Hole Diameter (mm) | DPF | MR |
|---|---|---|---|---|---|
| Ks | Small | 44 | 0.794 | 34.9 | 2.95 |
| Ll | Large | 24 | 2.381 | 54.5 | 3.05 |
| Ls | Small | 44 | 0.794 | 33.6 | 2.99 |
| Ml | Large | 24 | 3.175 | 55.4 | 3.05 |
| Ms | Small | 44 | 0.794 | 32.5 | 2.96 |

As will be appreciated by those skilled in the art, the cost of manufacturing a number of sealing plates for use in accordance with the present invention is significantly less than the cost of producing a corresponding number of metering plates or spinneret plates to effect various changes in filament count or denier mixtures. This is due primarily to the ease and simplicity of forming the flow channels in the sealing plate of the invention compared to the difficulties encountered in forming the compound shape of the precision drilled apertures in metering plates and spinneret plates.

The foregoing description is to be considered illustrative rather than restrictive of the invention, and those modifications which come within the meaning and range of equivalence of the claims are to be included therein.

What is claimed is:

1. A spinneret assembly comprising:

a spinneret plate with an upstream side and having a number of bores, each bore with one or more tapered sections; and a sealing plate adjacent to the upstream side of said spinneret plate and forming an interface therewith, said sealing plate having non-compound cylindrical flow channels formed therein, at least some of said flow channels having a first diameter and at least some of said flow channels having a second diameter, which is smaller than said first diameter and each of said flow channels corresponding in position to a bore in said spinneret plate.

2. The assembly of claim 1 wherein said flow channels are fewer in number than the number of bores in the spinneret plate.

3. The assembly of claim 1 wherein said sealing plate deflects and plastically deforms to form a seal under spinning pressure without reaching the ultimate plastic limit of the material from which the sealing plate was constructed.

4. The assembly of claim 3 wherein said sealing plate is formed from a material selected from:

mild steel;

stainless steel;

brass; and aluminum.

5. The assembly of claim 1 wherein said first diameter corresponds to the upstream diameter of said bores.

6. A spinneret assembly comprising:

a spinneret plate with an upstream side having a number of bores, each bore with one or more tapered sections; and a sealing plate positioned upstream from said spinneret plate, said sealing plate having non-compound cylindrical flow channels which are fewer in number than said bores and at least some of said flow channels having a first diameter, each of said flow channels corresponding in position to a bore in said spinneret plate.

7. The assembly of claim 6 wherein at least some of said flow channels have a second diameter which is smaller than said first diameter.

8. The assembly of claim 6 wherein said sealing plate deflects and plastically deforms to form a seal under spinning pressure without reaching the ultimate plastic limit of the material from which the sealing plate was constructed.

9. The assembly of claim 8 wherein said sealing plate is formed from a material selected from:

mild steel;
stainless steel;
brass; and
aluminum.

10. The spinneret assembly of claim 6 wherein said first diameter corresponds to the upstream diameter of said bores.

* * * * *